US006625902B2

(12) United States Patent
Yamamoto

(10) Patent No.: US 6,625,902 B2
(45) Date of Patent: Sep. 30, 2003

(54) SHOE SOLE AND SHOE

(76) Inventor: Seikichi Yamamoto, 9,Sugawara-dori 6-chome, Nagata-ku, Kobe-shi, Hyogo-ken (JP)

( * ) Notice: Subject to any disclaimer, the term of this patent is extended or adjusted under 35 U.S.C. 154(b) by 29 days.

(21) Appl. No.: 10/097,341

(22) Filed: Mar. 14, 2002

(65) Prior Publication Data

US 2002/0189132 A1 Dec. 19, 2002

(30) Foreign Application Priority Data

Apr. 25, 2001 (JP) ..... 2001-002517

(51) Int. Cl.[7] ..... A43B 7/08
(52) U.S. Cl. ..... 36/3 B; 36/102
(58) Field of Search ..... 36/3 R, 3 B, 102

(56) References Cited

U.S. PATENT DOCUMENTS 1,194,152 A * 8/1916 Douglas ..... 36/3 B
5,138,775 A * 8/1992 Chu ..... 36/3 B
5,505,010 A * 4/1996 Fukuoka ..... 36/3 B
5,768,806 A * 6/1998 Parisotto ..... 36/102
5,946,824 A * 9/1999 Tighe et al. ..... 36/3 B
6,393,732 B1 * 5/2002 Kita ..... 36/3 B

FOREIGN PATENT DOCUMENTS

GB 2245145 * 1/1992

* cited by examiner

*Primary Examiner*—Ted Kavanaugh
(74) *Attorney, Agent, or Firm*—Marshall, Gerstein & Borun LLP

(57) ABSTRACT

A shoe sole includes an outsole molded integrally out of rubber. The top of the outsole 11 is covered with an insole having air holes formed therethrough. A rim rises from and extends around the bottom of the outsole. A first middle plate, a second middle plate and a third middle plate are formed in the waist of the outsole and widthwise partition the inside of the rim. The first and third plates are positioned on the front and rear sides respectively of the second plate. The first and second plates have air openings respectively formed through upper portions thereof. Front plates widthwise partition the cavity surrounded by the rim and the first middle plate. The front plates have air openings formed through upper portions thereof. The outsole bottom has holes formed therethrough between the second and third middle plates. The tops of the holes are covered with a fabric. The outsole includes a front portion and a heel, which have different material compounding ratios such that the front portion is lower in hardness than the heel.

12 Claims, 6 Drawing Sheets

SHOE SOLE AND SHOE

FIELD OF THE INVENTION

The present invention relates to a shoe sole and a shoe. In particular, the invention relates to a shoe sole including a front portion and a heel that differ greatly in hardness.

BACKGROUND OF THE INVENTION

A conventional shoe sole includes an outsole and an insole. The whole of the outsole is integrally molded out of uniform elastic material. The outsole includes a bottom and a rim, which rises from and extends around the bottom. The insole is bonded to the top of the rim. A shoe sole of this type is disclosed in Japanese Utility Model Registration No. 3,056,650, for example. The waist of the outsole of the disclosed sole includes a first middle plate, a second middle plate and a third middle plate that are formed inside the outsole rim. The first and third middle plates are positioned on the front and rear sides respectively of the second middle plate. The middle plates rise from and extend across the outsole bottom. The first and second middle plates have air (vent) openings formed through their tops. The rim and the first middle plate define a front cavity, in which a number of front plates rise from and extend across the outsole bottom. The front plates have air (vent) openings formed through their tops, and incline forward. The outsole bottom has a hole formed through it between the second and third middle plates. The top of the hole is covered with a fabric that is air-permeable and not water-permeable.

When the wearer's foot applies a high pressure on a front portion of the insole, the cavity of the outsole is compressed and deforms. The air in the compressed cavity under the insole is discharged through the air openings of the front, first middle and second middle plates and the bottom hole between the second and third middle plates out of the shoe. The sole is effective as a means for discharging the air in the shoe by utilizing the compressive performance of the elastic material. The inclining front plates improve the cushioning property of the shoe, making the shoe comfortable.

Because the sole is integrally molded out of uniform elastic material, its hardness is uniform. A front portion of the outsole rim of the integral sole is so hard that the outsole cavity is less compressible. This prevents sufficient discharge of the air in the cavity. A front portion of the integral sole is so hard that the shoe is not sufficiently comfortable.

SUMMARY OF THE INVENTION

The object of the present invention is to provide a shoe sole that improves the suction into and exhaust from a shoe and makes the shoe comfortable.

A shoe sole according to the present invention includes an outsole molded integrally out of rubber. The top of the outsole is covered with an insole. A rim is formed around the bottom of the outsole. A first middle plate, a second middle plate and a third middle plate are formed in the waist of the outsole and widthwise partition the inside of the rim. The first and third middle plates are positioned on the front and rear sides respectively of the second middle plate. The first and second middle plates have air openings formed through upper portions thereof. Front plates are formed in the cavity surrounded by the rim and the first middle plate. The front plates have air openings formed through upper portions thereof. The cavity is covered with the insole to form a space. The outsole has a hole formed through the bottom thereof between the second and third middle plates. The top of the hole is covered with a fabric that is air-permeable and not water-permeable. The outsole includes a front portion and a heel, which have different compounding ratios between the bulking and softening agents of the material for the outsole such that the front portion is considerably lower in hardness than the heel.

Thus, the front portion of the outsole is greatly lower in hardness than the heel of the outsole so as to be elastic and more flexible, making the cavity in the front portion more compressible. This improves the air suction and exhaust efficiency of the space formed in the cavity covered with the insole. This also improves the cushioning property of the shoe, making the shoe very comfortable.

And the cushioning property depends on the front portion's softness not for on the air-tube. So shoe keeps a long life of the cushioning property without worrying about leakage of air.

The insole may have an air hole formed therethrough over the outsole cavity. Air can be discharged through this hole as well. This makes it possible to improve the exhaust efficiency and the suction.

The insole may include an upper layer made of continuously foamed material. The use of this layer in a shoe makes the shoe more comfortable, without lowering the suction and exhaust efficiency.

Men's and women's shoes may each be made with a sole according to the present invention. The use of this sole makes each shoe not liable to be stuffy, and makes each shoe more comfortable.

BRIEF DESCRIPTION OF THE DRAWINGS

Preferred embodiments of the present invention are shown in the accompanying drawings, in which.

DETAILED DESCRIPTION OF THE PREFERRED EMBODIMENTS

Figure 1:
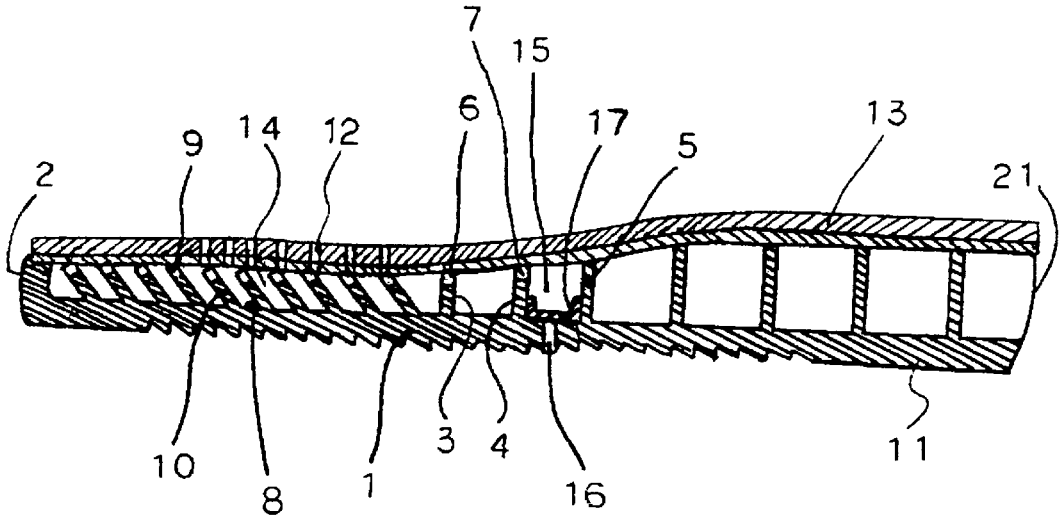
FIG. 1 is a sectional side view of a shoe sole embodying the invention.
Figure 2:
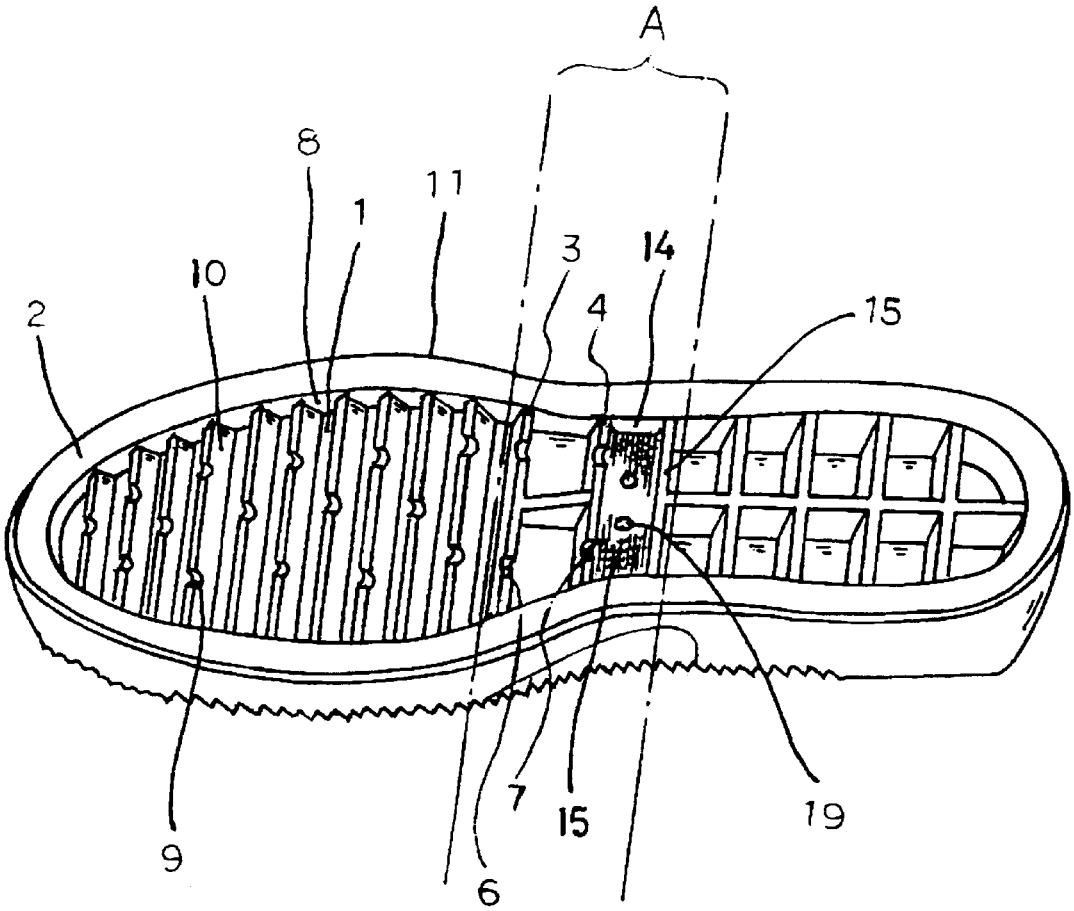
FIG. 2 is a perspective view of the outsole of the sole.

As shown in FIGS. 1–4, a shoe sole 21 consists of an outsole 11 and an insole 13. The outsole 11 is molded integrally out of rubber. The top of the outsole 11 is covered wholly with the insole 13, which has air (vent) holes 12 formed through it. The outsole 11 includes a bottom 1 and a rim 2 in the form of a wall, which rises from and extends around the bottom. The waist A of the sole 21 includes a first middle plate 3, a second middle plate 4 and a third middle plate 5, which widthwise partition the inside of the rim 2. The first and third plates 3 and 5 are positioned on the front and rear sides respectively of the second plate 4. The first and second plates 3 and 4 have air (vent) openings 6 and 7 respectively formed through their tops. The rim 2 and the first plate 3 define a front cavity 8, which is partitioned widthwise with a number of front plates 10. The front plates 10 have air (vent) openings 9 formed through their tops, and incline forward at about 50 degrees.

The insole 13 has air (vent) holes 12 formed through it and opening into the cavity 8, and consists of an upper sheet 18 and a lower sheet 19. The upper sheet 18 is made of continuously foamed elastic material, where the air bubbles act as air holes. The lower sheet 19 includes a mesh layer. The outsole bottom 1 has holes 16 formed through it between the second and third middle plates 4 and 5. The tops of the bottom holes 16 are covered with a fabric 17 that is air-permeable and not water-permeable. It is preferable that the fabric 17 Is a fabric made by Toray Industries, Inc. by undergoing Entrance Processing.

The outsole 11 is made of SBR (styrene-butadiene rubber). Herein, the front portion, waist A and heel of the outsole 11 are defined as the outsole portion forward from the first middle plate 3, the outsole portion between the first and third middle plates 3 and 5, and the outsole portion rearward from the third middle plate 5, respectively. The front portion and heel of the outsole 11 have different compounding ratios between the bulking and softening agents of the material for them in such a manner that the front portion is considerably lower in hardness than the heel.

The specific amounts of filler (W carbon) compounded in the front portion and the heel of the outsole 11 are 0.28 and 0.40 phr (parts per hundred parts of rubber) respectively. The specific amounts of softener (oil) compounded in the front portion and the heel of the outsole 11 are 0.12 and 0.04 phr respectively. Table 1 shows examples of the compounding ratios.

TABLE 1

| MATERIALS | FRONT PORTION | HEEL |
|---|---|---|
| SBR (rubber) | 25 weight parts | 23 weight parts |
| High Styrene | — | 2 weight parts |
| W Carbon | 7 weight parts | 10 weight parts |
| VCR | 5 weight parts | 5 weight parts |
| Oil | 3 weight parts | 1 weight part |

It is assumed that a man is walking in shoes each including the sole 21. When the center of gravity of the walker's weight shifts from his heel to his toes, force acts that presses the front portion of the insole 13 downward. The force compresses and deforms the front cavity 8 of the outsole 11 through the insole 13. As a result, air is forced out of the front space 14 defined by the insole 13 and the cavity 8. Because the front portion of the outsole 11 is lower in hardness, it is easier to deform the cavity 8 and accordingly force air out of the front space 14. This improves the exhaust efficiency. When the cavity 8 is restored to its original form, the front space 14 sucks in air.

The air forced out of the front space 14 flows through the openings 9 of the inclined front plates 10 and the openings 6 and 7 of the first and second middle plates 3 and 4 respectively into the waist space 15 defined by the rim 2, the outsole bottom 1, the insole 13, and the second and third middle plates 4 and 5.

Figure 4:
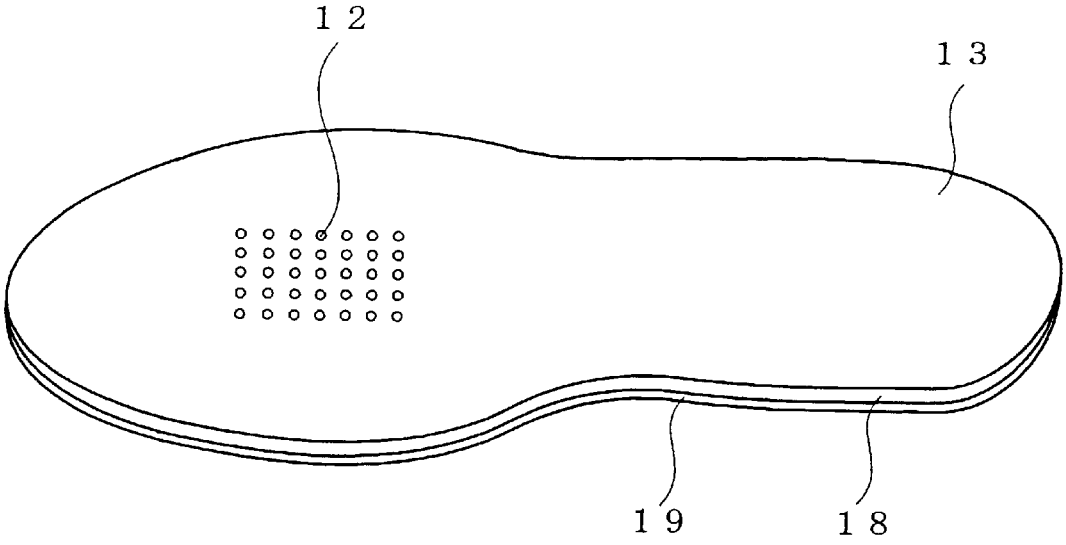
FIG. 4 is a perspective view of the insole of the sole.

Thereafter, the air is discharged out of the shoe through the fabric 17 and the holes 16 in the bottom of the waist space 15. As shown in FIG. 4, the insole 13 has air holes 12, through which air can also flow from the front space 14 into the shoe.

When the walker's center of gravity shifts from his toes to his heel, the rubber repulsion of the compressed and deformed rim 2 restores the compressed front space 14 to its original state, with the space 14 exerting suction due to the lowered pressure in it.

As a result, air is taken in from the inside of the shoe through the insole holes 12 into the front space 14, while air flows from the outside of the shoe through the outsole holes 16 into the waist space 15, from which it is taken in through the openings 6 and 7 of the first and second middle plates 3 and 4 into the front space 14.

When air flows from the outside of the shoe through the outsole holes 16 into the waist space 15, the fabric 17 over the holes 16 keeps water, mud, etc. from entering the shoe.

Such actions are repeated, replacing in the front space 14 the air in the shoe with fresh air, and gradually ventilating the inside of the shoe.

Figure 3:
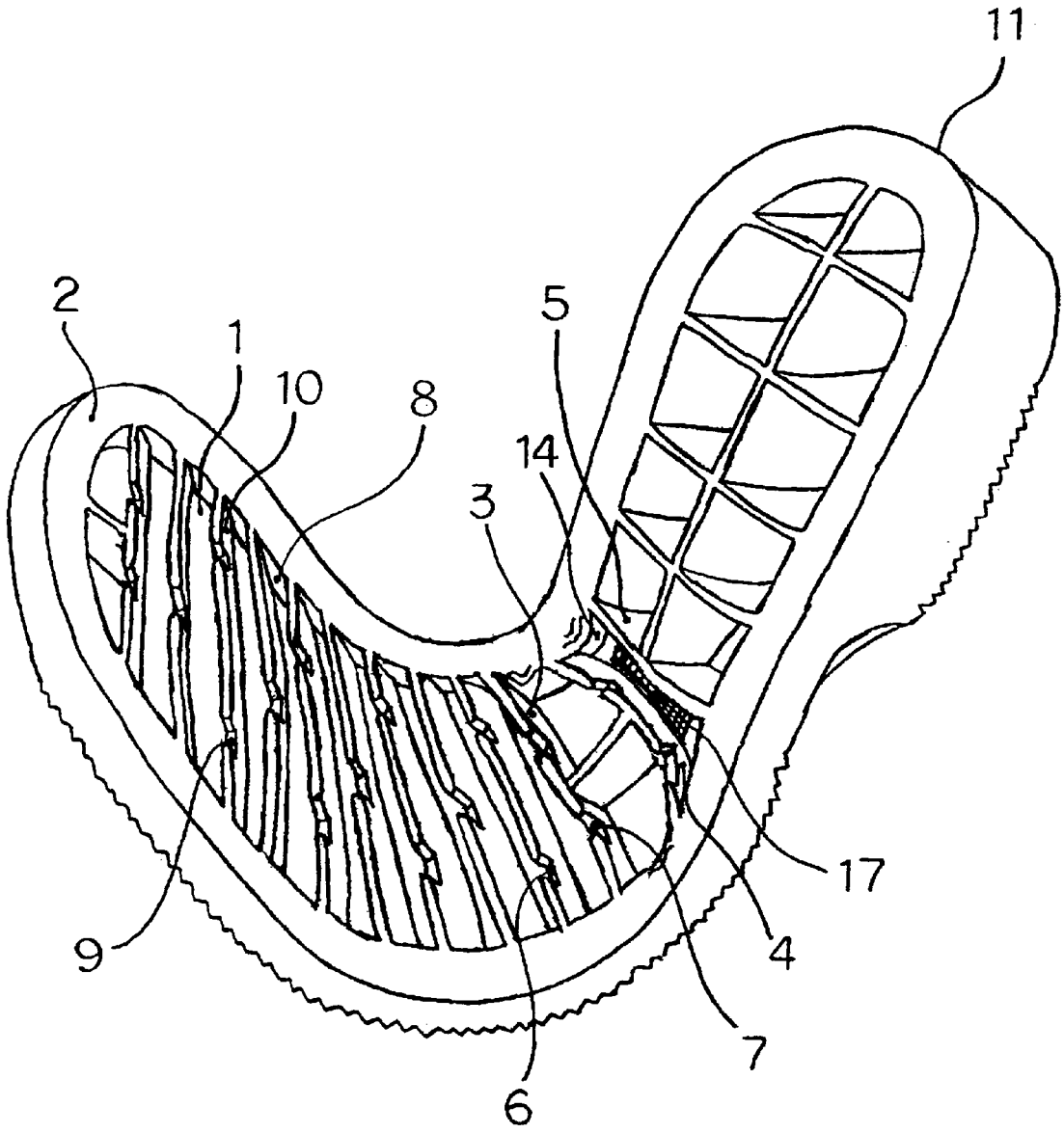
FIG. 3 is a perspective view of the outsole, showing the outsole bending.

When the sole 21 is bent, as shown in FIG. 3, the front portion of the outsole 11 is bent and deformed easily and fully with slight force because it is flexible. As stated already, the application of a slight load on the front portion perpendicularly compresses and deforms this portion. By contrast, the heel of the outsole 11 is difficult to deform, can bear the walker's weight and is stable. The shoe is made comfortable by a balance attained between the flexibility of the front portion and the non-compressibility and stability of the heel.

Figure 5:
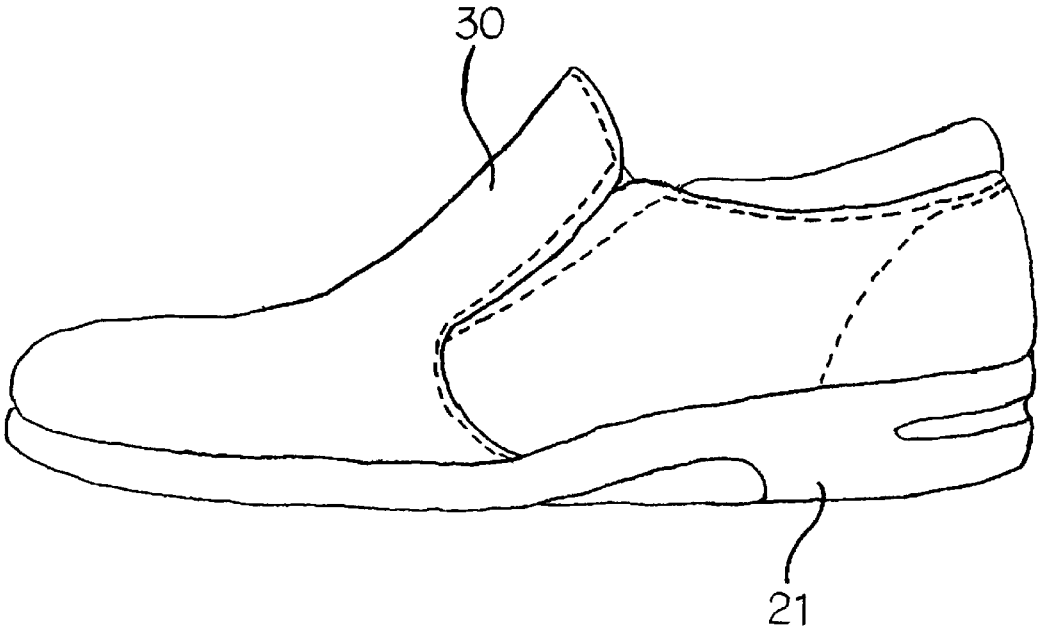
FIG. 5 is a side view of a men's shoe including a sole embodying the invention.
Figure 6:
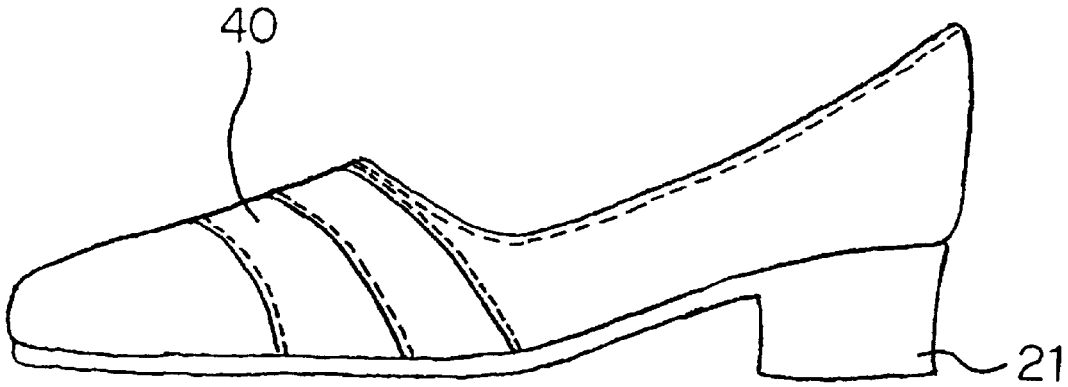
FIG. 6 is a side view of a women's shoe including a sole embodying the invention.

FIGS. 5 and 6 show a men's shoe 30 and a women's shoe 40 respectively, each of which is made with a sole 21 according to the embodiment. The sole 21 of the woman's shoe 40 is considerably thinner than that of the man's shoe 30, but fully exerts its original suction and exhaust. The high flexibility of the front portion of the thinner sole 21 makes the women's shoe 40 very comfortable, and this sole can compare with the thicker sole 21 of the men's shoe 30.

What is claimed is:

1. A shoe sole comprising an outsole molded integrally out of rubber, an insole covering the top of the outsole, and a rim formed around the bottom of the outsole, the sole further comprising a first middle plate, a second middle plate and a third middle plate formed in the waist of the outsole and widthwise partitioning the inside of the rim, the first and third middle plates being positioned on the front and rear sides respectively of the second middle plate, the first and second middle plates having air openings formed through upper portions thereof, the sole further comprising a plurality of front plates widthwise partitioning the cavity surrounded by the rim and the first middle plate, the front plates having air openings formed through upper portions thereof, the insole covering the cavity to form a space, the outsole having a hole formed through the bottom thereof between the second and third middle plates, the sole further comprising a fabric covering the top of the hole and being air-permeable and not water-permeable, the outsole including a front portion forward from the first middle plate and a rear portion rearward from the third middle plate, the front and rear portions having different compounding ratios between the bulking and softening agents of the material for the outsole such that the front portion is considerably lower in hardness than the rear portion.

2. A shoe sole according to claim 1 wherein the insole has an air hole formed therethrough over the cavity.

3. A shoe according to claim 2 wherein the insole includes an upper layer made of continuously foamed material.

4. A men's shoe made with a sole according to claim 3.

5. A men's shoe made with a sole according to claim 3.

6. A men's shoe made with a sole according to claim 2.

7. A women's shoe made with a sole according to claim 2.

8. A shoe sole according to claim 1 wherein the insole includes an upper layer made of continuously foamed material.

9. A men's shoe made with a sole according to claim 8.

10. A women's shoe made with a sole according to claim 8.

11. A men's shoe made with a sole according to claim 1.

12. A women's shoe made with a sole according to claim 1.

* * * * *